US010792555B2

(12) United States Patent
Gaynor et al.

(10) Patent No.: US 10,792,555 B2
(45) Date of Patent: Oct. 6, 2020

(54) SECURE SUBSTRATE FOR SCRATCH-OFF PRODUCTS

(71) Applicants: Mohawk Fine Papers Inc., Cohoes, NY (US); Hydra Management LLC, New York, NY (US)

(72) Inventors: Gavin Lee Gaynor, Hudson Village, OH (US); Paul John Stamas, Troy, NY (US); Kenneth E. Irwin, Jr., Dawsonville, GA (US); Fred W. Finnerty, Dawsonville, GA (US)

(73) Assignee: Hydragraphix LLC, New York, NY (US)

( * ) Notice: Subject to any disclaimer, the term of this patent is extended or adjusted under 35 U.S.C. 154(b) by 106 days.

(21) Appl. No.: 16/310,170

(22) PCT Filed: Jun. 16, 2017

(86) PCT No.: PCT/US2017/038028
§ 371 (c)(1),
(2) Date: Dec. 14, 2018

(87) PCT Pub. No.: WO2017/218992
PCT Pub. Date: Dec. 21, 2017

(65) Prior Publication Data

US 2019/0176023 A1 Jun. 13, 2019

Related U.S. Application Data

(63) Continuation of application No. 15/284,415, filed on Oct. 3, 2016, now Pat. No. 9,861,883.
(Continued)

(51) Int. Cl.
*A63F 3/06* (2006.01)
*B42D 25/21* (2014.01)
(Continued)

(52) U.S. Cl.
CPC ..... *A63F 3/0665* (2013.01); *B42D 15/025* (2013.01); *B42D 25/21* (2014.10);
(Continued)

(58) Field of Classification Search
CPC ..... A63F 3/0665; B42D 25/21
See application file for complete search history.

(56) References Cited

U.S. PATENT DOCUMENTS 4,540,628 A 9/1985 Oberdeck et al.
5,213,664 A 5/1993 Hansell
(Continued)

FOREIGN PATENT DOCUMENTS

EP 0608065 A2 7/1994
EP 1997643 A2 12/2008
(Continued)

OTHER PUBLICATIONS

"Partial Supplementary European Search Report", EP17814237.8 (14 pages), dated Jan. 22, 2020.
(Continued)

*Primary Examiner* — Cachet I Proctor
(74) *Attorney, Agent, or Firm* — Neal, Gerber & Eisenberg LLP

(57) ABSTRACT

In one embodiment, a secure substrate provides a print-ready surface for printing scratch-off products and eliminates the need to print lower security layers for protecting against attempts to view hidden indicia information. In one embodiment, a secure substrate comprises applying microperforations to a dyed substrate that meets a predefined transmission optical density to resist an attempt to reduce the opacity of the dyed substrate by delamination. In another embodiment, a secure substrate comprises applying a lower opacity layer and a lower background layer on a substrate to provide a secure substrate that meets a predefined transmission
(Continued)

optical density. In another embodiment, a secure substrate comprises applying a lower opacity layer on a substrate, applying a reflective coating, and applying a lower background layer over the reflective coating to provide a secure substrate that meets a predefined transmission optical density.

11 Claims, 5 Drawing Sheets

Related U.S. Application Data

(60) Provisional application No. 62/351,862, filed on Jun. 17, 2016.

(51) Int. Cl.

| | |
|---|---|
| ***B42D 15/02*** | (2006.01) |
| ***B42D 25/45*** | (2014.01) |
| ***B42D 25/351*** | (2014.01) |
| ***B42D 25/346*** | (2014.01) |
| ***B42D 25/373*** | (2014.01) |
| *B41M 3/00* | (2006.01) |
| *B41M 3/14* | (2006.01) |
| *G09F 3/00* | (2006.01) |

(52) U.S. Cl.

CPC ..... *B42D 25/346* (2014.10); *B42D 25/351* (2014.10); *B42D 25/373* (2014.10); *B42D 25/45* (2014.10); *A63F 2003/067* (2013.01); *B41M 3/005* (2013.01); *B41M 3/14* (2013.01); *G09F 3/0288* (2013.01); *Y10S 283/903* (2013.01)

(56) References Cited

U.S. PATENT DOCUMENTS

| | | | | |
|---|---|---|---|---|
| 5,215,811 | A | 6/1993 | Reafler et al. | |
| 5,346,258 | A * | 9/1994 | Behm | A63F 3/0665 283/102 |
| 5,532,046 | A * | 7/1996 | Rich | A63F 3/0665 283/100 |
| 5,569,512 | A | 10/1996 | Brawner et al. | |
| 5,667,250 | A * | 9/1997 | Behm | A63F 3/0685 283/102 |
| 5,704,647 | A | 1/1998 | Desbiens | |
| 5,752,152 | A | 5/1998 | Gasper et al. | |
| 6,042,888 | A * | 3/2000 | Sismanis | B44F 1/04 101/129 |
| 6,047,964 | A * | 4/2000 | Lawandy | A63F 3/0685 273/138.1 |
| 6,340,517 | B1 | 1/2002 | Propst, Jr. | |
| 6,533,325 | B1 | 3/2003 | Steidinger | |
| 6,916,047 | B2 * | 7/2005 | Jarvis | B32B 7/12 283/102 |
| 7,008,317 | B2 * | 3/2006 | Cote | G07F 17/32 463/16 |
| 7,029,757 | B1 | 4/2006 | Levy | |
| 7,090,913 | B2 | 8/2006 | Bourdelais et al. | |
| 7,670,450 | B2 | 3/2010 | Lamansky et al. | |
| 8,289,594 | B2 | 10/2012 | Drinkwater | |
| 8,367,277 | B2 | 2/2013 | Brehm et al. | |
| 8,403,368 | B2 | 3/2013 | Tompkin et al. | |
| 2002/0185033 | A1 * | 12/2002 | Shepard | B41M 3/14 106/31.6 |
| 2003/0068470 | A1 | 4/2003 | Bourdelais et al. | |
| 2008/0311349 | A1 | 12/2008 | Johnson et al. | |
| 2009/0263583 | A1 | 10/2009 | Mantell et al. | |
| 2009/0291258 | A1 | 11/2009 | Higashi | |
| 2009/0303558 | A1 * | 12/2009 | Drinkwater | A63F 3/06 359/2 |
| 2011/0114148 | A1 | 5/2011 | Temchenko et al. | |
| 2012/0025516 | A1 * | 2/2012 | Miller | A63F 3/0655 283/100 |
| 2012/0139230 | A1 | 6/2012 | Whiteman et al. | |
| 2012/0227809 | A1 | 9/2012 | Bharti et al. | |
| 2012/0267888 | A1 * | 10/2012 | Behm | B42D 25/378 283/100 |
| 2014/0312606 | A1 | 10/2014 | Lister | |
| 2016/0075164 | A1 | 3/2016 | Sarrazin | |
| 2016/0107472 | A1 | 4/2016 | Garcia Juez et al. | |
| 2016/0108581 | A1 | 4/2016 | Olmos et al. | |
| 2016/0339734 | A1 * | 11/2016 | Lavoie | A63F 3/0665 |

FOREIGN PATENT DOCUMENTS

| | | | |
|---|---|---|---|
| EP | 2681054 | A1 | 1/2014 |
| JP | 2014168927 | A | 9/2014 |
| WO | 2012117053 | A1 | 9/2012 |

OTHER PUBLICATIONS

Int'l Search Report dated Sep. 18, 2017 in Int'l Application No. PCT/US2017/038028.

Int'l Preliminary Report on Patentability dated Dec. 18, 2018 in Int'l Application No. PCT/US2017/038028.

* cited by examiner

SECURE SUBSTRATE FOR SCRATCH-OFF PRODUCTS

CROSS REFERENCE TO RELATED APPLICATION

This application is a Section 371 of International Application No. PCT/US2017/038028, filed Jun. 16, 2017, which was published on Dec. 21, 2017, under International Publication No. WO 2017/218992 A1, and which claims the benefit of U.S. provisional patent application No. 62/351,862, filed on 17 Jun. 2016, and U.S. non-provisional patent application Ser. No. 15/284,415, filed on 3 Oct. 2016, all of which are incorporated herein by reference in their entirety.

FIELD OF THE INVENTION

This invention generally relates to improving the security and aesthetics of products having indicia under a scratch-off-coating (SOC) by providing a secure substrate for printing such products.

BACKGROUND OF THE INVENTION

The concept of hiding indicia information under a SOC has been applied to numerous products, including, for example, lottery scratch-off tickets or instant games, commercial contests, telephone cards, gift cards, among many others ("scratch-off products"). Billions of scratch-off products are printed every year. Typically the indicia information (e.g., barcode, account number, win/loss information, or any other information hidden under a SOC) is the only information on a scratch-off product that is variable or different from ticket-to-ticket. For example, the variable indicia information on some scratch-off lottery tickets indicates a loss, while others indicate a free play or a win of a specified dollar amount.

The purpose of the SOC is to securely hide the indicia information of scratch-off products and ensure that the indicia cannot be read or decoded without removing the SOC. The SOC also ensures that the product has not been previously used, played, or modified. Scratch-off products also include lower security layers to ensure that the indicia cannot be read or decoded from the backside of the scratch-off product. The lower security layers, SOC and graphic display of scratch-off products are typically printed using flexography (i.e., a printing process that uses fixed plates) or gravure (i.e., a printing process that uses fixed cylindrical image carriers) due to the speed and reliability associated with printing a long run (e.g., millions of copies) of the same scratch-off product. To accommodate the high-speed fixed-plate printing process, the indicia information is typically printed using a single-color high-speed inkjet printer, with an ink-jet dye that has a substantially different chemical composition from the flexographic inks used for the layers above and below the indicia.

Individuals have developed various techniques to temporarily reveal the hidden indicia under the SOC of scratch-off products, which leave little or no trace that the scratch-off product was compromised. If the indicia can be read or decoded without removing the SOC, individuals can identify winning lottery tickets and sell only losing tickets, use telephone cards and subsequently sell them as new, and so on. Various techniques are used to temporarily reveal the hidden indicia under the SOC of scratch-off products, which leave little or no trace that the scratch-off product was compromised.

Candling is one technique that is used to reveal the hidden indicia, either from the front or backside of a scratch-off product, by using a powerful light source to overcome the security layers that provide opacity (i.e., designed to block the transmission of light). Candling techniques generally use visible wavelengths of light, but other wavelengths (e.g. infrared) may also be used. If the light source is capable of emitting light that has enough intensity to overcome the opacity of the layers above or below the indicia (i.e., enough light passes through the layers of the scratch-off product), an individual can read the indicia either directly with the naked eye or through the use of a digital camera (e.g., long exposure). This concept can be demonstrated by using a black crayon to block out text on a sheet of paper. If low intensity light is directed towards the blocked out text, the black layer will absorb nearly all of the light and the blocked out text will remain hidden. If high intensity light is directed towards the blocked out text, some of the light will be transmitted through the paper and an individual will be able to read the previously blocked out text.

Diffusion is another technique that reveals the hidden indicia under the SOC by applying a solvent (e.g., alcohol) to a scratch-off product. The solvent penetrates the upper layers of the scratch-off product and saturates the indicia dye and resin. The indicia dye is absorbed by the solvent, causing a portion of the indicia to diffuse through the upper layers of the scratch-off product, revealing a faint image of the underlying indicia. After the scratch-off product is allowed to dry, the faint image of the underlying indicia disappears from the face of the scratch-off product, leaving little to no trace that the indicia was identified via diffusion. Diffusion allows a user to generate a signal representative of the dye used for the indicia information relative to the sections of the scratch-off product surrounding the indicia—i.e., measuring a positive signal-to-noise ratio (SNR) identifying the hidden indicia without altering the SOC.

Another technique that reveals the hidden indicia under the SOC is induced fluorescence. Fluorescence is induced by supplying light of a particular wavelength that causes the indicia dye to fluoresce. The fluorescing dye emits light having wavelengths that are characteristic of the chemical composition of the dye. The different ink used for sections of the scratch-off product surrounding the indicia either emit no light or light of a different wavelength from the indicia dye. The fluorescent light emitted by the indicia dye is then captured by using a digital camera with an optical filter that only allows fluorescent light of a narrow set of wavelengths to pass through the filter. Similar to diffusion, fluorescence allows a user to measure a positive SNR identifying the hidden indicia without altering the SOC.

Another technique involves applying an electrostatic charge to a scratch-off product. Applying an electrostatic charge to the scratch-off product may induce a differential charge in the indicia dye relative to the sections of the scratch-off product surrounding the indicia. An electrophotographically printed (e.g. dry toner) indicia would be particularly susceptible to this technique, as toner is specifically designed to carry charge as an essential part of the image creation process. If an electrostatically sensitive powder (e.g., baby powder) is applied over the SOC, the powder will align in the two-dimensional shape of the indicia under the SOC. Similar to diffusion and fluorescence, the electrostatic charge allows a user to measure a positive SNR identifying the hidden indicia without altering the SOC.

Another technique for viewing the hidden indicia information is mechanically lifting the SOC using a thin blade (e.g., an X-ACTO blade) or other device to peel back a portion of the SOC to reveal the hidden indicia. The SOC is then glued back into place to conceal that the SOC was lifted to view the indicia.

Over the last few decades, the scratch-off product industry has redesigned the substrate (e.g., paper, plastic, foil, film or any other suitable material for printing scratch-off products), developed chemical barriers, and redesigned the SOC to resist known techniques for revealing the indicia. For example, the scratch-off product industry has attempted to increase the opacity of the substrate to resist candling by dying the substrate black, grey or some other color that reduces the transmission of light through the substrate (i.e., developing dark-core substrate) and increasing the thickness of the substrate to 10 mils or 254 μm.

The protect and release coat, which seals the indicia information and allows the SOC to scratch-off, has been modified to block known solvents from penetrating to the indicia.

However, modifying the protect and release coat to resist known diffusion attacks often requires use of costly chemical compounds and complex curing processes involving the use of ultraviolet light or an electron beam to cure the protect and release coat in a controlled environment.

Further, the protect and release coat does not protect from diffusion techniques applied to the backside of a scratch-off product. Although the layers below the indicia may also include a barrier or seal for resisting diffusion, these lower layers typically provide less protection as they must provide an adequate surface for the upper layers of the scratch-off product to adhere to. The industry has added layers above and below the indicia to block predefined wavelengths (e.g. ultraviolet and infrared) indicative of the chemical composition of the indicia.

The industry has also implemented anti-static barriers such as conductive polymer layers to resist electrostatic attempts to induce a differential charge in the indicia. The industry has also redesigned the SOC so that the coating crumbles or flakes (as opposed to peeling off in on piece), making it more difficult to conceal an attempt to mechanically lift the SOC to view the indicia.

Yet the scratch-off product industry has not identified a solution for resisting all fluorescence attacks. The inkjet dye used for the printing the indicia is composed of compounds having high molecular mass that tend to fluoresce in response to a large number of wavelengths of light (e.g., 100,000 or more wavelengths may cause fluorescence). Thus, it is nearly impossible to design barriers that block every possible wavelength that can cause fluorescence in the indicia dye. Additionally, minute variations in the chemical composition of the indicia dye, which do not affect the appearance of the indicia and are considered acceptable for printing, may greatly alter the fluorescence characteristics of the indicia dye. Accordingly, wavelengths of light that did not cause fluorescence in previously tested indicia dye may result in fluorescence due to the minute variations in the chemical composition of the indicia dye. Even if reliable blocking layers are engineered to block nearly all wavelengths of light, digital cameras using long timed exposures and appropriately tuned narrow-band optical filters are capable of capturing minute emissions of fluorescence from the indicia dye, revealing the hidden indicia information.

The scratch-off product industry also continues to be challenged to address the problem of assisted mechanical lifts to view hidden indicia under the SOC. Assisted mechanical lifts involve applying a material to the SOC (e.g., clear acrylic coating) that strengthens the SOC and resists crumbling or flaking when a user attempts to mechanically lift the SOC. That means users can more easily glue the SOC back into place, concealing the mechanical lift.

Further, scratch-off products are still printed using indicia dye that has a different chemical composition from the inks used for the layers above and below the indicia. Because many of the various techniques for identifying hidden indicia information of a scratch-off product rely on the indicia dye having a different chemical composition from the inks used for the layers above and below the indicia, the possibility still remains that new techniques may be developed in the future for inducing diffusion, fluorescence, electrostatic charge, or some other characteristic feature to identify hidden indicia information.

The scratch-off product industry also continues to be challenged to develop an efficient printing process that addresses the problem of candling without impacting the aesthetics of scratch-off products. One technique for resisting candling involves the use of foil-laminated substrates to provide opacity for scratch-off products (see e.g., U.S. Pat. No. 4,540,628 to Koza et al.). Although the use of foil-laminated substrate is not susceptible to delamination (i.e., peeling off the foil laminate from the substrate would still protect the overlying indicia) and resists candling (i.e., bright light is reflected by foil), the opacity is provided by thick foil and various layers of varnish, which is not recyclable.

Another technique involves the use of dark-core substrates (see e.g., U.S. Pat. No. 5,213,664 of Hansell and U.S. Pat. No. 6,340,517 of Propst). Unlike foil-laminated substrate, dark-core substrate is recyclable because it does not contain metal. However, dark-core substrate relies on the thickness of the substrate for opacity and can easily be delaminated (i.e., the substrate can be soaked in liquid and peeled into two thinner halves each of which has significantly less opacity than the original substrate) to view the hidden indicia via candling. The substrate could then be glued back together to conceal the delamination.

The scratch-off product industry also applied thin metalized ink film directly to the substrate via flexographic or gravure printing (see e.g., U.S. Pat. No. 5,532,046 of Rich et al.). Although the thinner metalized ink film is more environmentally friendly than foil-laminated substrate, it does not provide sufficient opacity to protect against candling.

In the late 1990s, the scratch-off product industry developed security layers comprised of black and white ink film coatings that could be printed using flexographic plates and/or gravure cylinders. These security layers replaced the use of dark-core substrates and foil-laminated stock as they were not susceptible to delamination and provided adequate protection against candling. However, the addition of lower-security layers has resulted in elaborate press configurations that require significant testing and verification to setup a press run of a scratch-off product. For example, printing a scratch-off product may require using up to 29 different flexographic plates for each color separation or sub-layer. Eight of the plates are typically used for printing the upper and lower opacity layers (2 layers of black each) and upper and lower background layers (2 layers of white each).

Printing lower security layers on the substrate also impacts the aesthetics of scratch-off products. Because the upper and lower opacity layers are comprised of dark colors, the white background layers are unable to fully mask the color black, resulting in a tinted grey surface that may also have a rough surface texture that distorts the overlaid graphics of the scratch-off product. If colorful images are printed on the upper or lower background layers, the resulting grey surface distorts the colors causing the colors to appear dull. Some scratch-off products use additional background layers to brighten the background, however, the cost of additional white layers is significant and adds to the complexity of the press configuration for printing a scratch-off product.

Further, the level of opacity provided by the security features of a scratch-off product are not well-defined within the industry. For example, the scratch-off product industry uses trial and error and likely excessive amounts of colorant to achieve some undefined level of "total opacity" (see e.g., U.S. Pat. No. 5,213,664 of Hansell) rather than defining a range of acceptable opacities and designing the opacity coating to meet the defined opacity. The term "total opacity" does not define any particular opacity, as the measurement of opacity (i.e., the ability of a material to block the transmission of light) is a function of the intensity of light provided by a light source. A material that has an opacity of 99.9 percent (i.e., transmittance of 0.001) may be measured to have 100 percent opacity (i.e., zero transmittance) if the intensity of the light source is so low that the transmitted light signal is too small to detect.

Due to the lack of better techniques for resisting delamination, candling, fluorescence, electrostatic charge, and assisted/unassisted mechanical lifts, security ink film coatings and indicia dye that has a different chemical composition from the inks used for the layers above and below the indicia remain in wide usage for the production of scratch-off products. Further, the inability to design security coatings to meet defined opacities results in significant added cost and wasted materials in the production of scratch-off products. Accordingly, there is an unmet demand for a method of efficiently printing scratch-off products that effectively resists known and unknown techniques for revealing the hidden indicia information and allows for improvements to the aesthetic design of scratch-off products.

SUMMARY OF THE INVENTION

In one embodiment, a secure substrate includes a dark-core substrate that is comprised of a substrate having a first thickness and an opacifiying agent having a concentration, a lower background layer having a second thickness, and microperforations that penetrate the dark-core substrate. The lower background layer is applied above the dark-core substrate. Further, the secure substrate meets a predefined transmission optical density that is a function of the first thickness, the second thickness, and the concentration.

In one embodiment, the transmission optical density is at least 3.5. In one embodiment, the microperforations penetrate the front side and the back side of the dark-core substrate to a combined depth that does not exceed half the thickness of the substrate. In another embodiment, the microperforations penetrate the lower background layer and the dark-core substrate. In one embodiment, the first thickness is about 8 mils, the second thickness is about 1 mil, and the concentration is about 0.5 percent by weight.

In one embodiment, a secure substrate includes a substrate, a lower opacity layer having a first thickness and an opacifying agent having a concentration, and a lower background layer having a second thickness. The lower opacity layer is applied above the substrate and the lower background layer is applied above the lower opacity layer. Further, the secure substrate meets a predefined transmission optical density that is a function of the first thickness, the second thickness, and the concentration.

In one embodiment, the transmission optical density is at least 3.5. In one embodiment, the lower opacity layer is comprised of process black and carbon black. In one embodiment, the secure substrate further includes a reflective coating applied above the lower opacity layer having a third thickness. In this embodiment, the transmission optical density is further a function of the third thickness. In one embodiment, the first thickness is about 1 mil, the second thickness is about 1 mil, and the concentration is about 2.5 percent by weight. In another embodiment, the first thickness is about 1 mil, the second thickness is about 1 mil, the third thickness is about 1 micron, and the concentration is about 2.5 percent by weight.

In one embodiment, a method of making a secure substrate includes defining a transmission optical density of the secure substrate, selecting a substrate, selecting a first thickness for applying a lower background layer, and applying the lower background layer above the substrate. The method further includes measuring the transmission optical density of the secure substrate and determining whether the measured transmission optical density meets or exceeds the defined transmission optical density In one embodiment, the defined transmission optical density is 3.5.

In one embodiment, the selected substrate is a dark-core substrate. In this embodiment, the method further comprises selecting a second thickness for the dark-core substrate and a concentration of an opacifying agent for the dark-core substrate.

In one embodiment, the measured transmission optical density is a function of the first thickness, the second thickness and the concentration. In one embodiment, the method further comprises applying microperforations that penetrate the dark-core substrate. In one embodiment, the method further comprises selecting a second thickness for a lower opacity layer, selecting a concentration of an opacifying agent for the lower opacity layer, and printing the lower opacity layer above the substrate. In one embodiment, the measured transmission optical density is a function of the first thickness, the second thickness and the concentration.

DETAILED DESCRIPTION OF THE INVENTION

Figure 1:
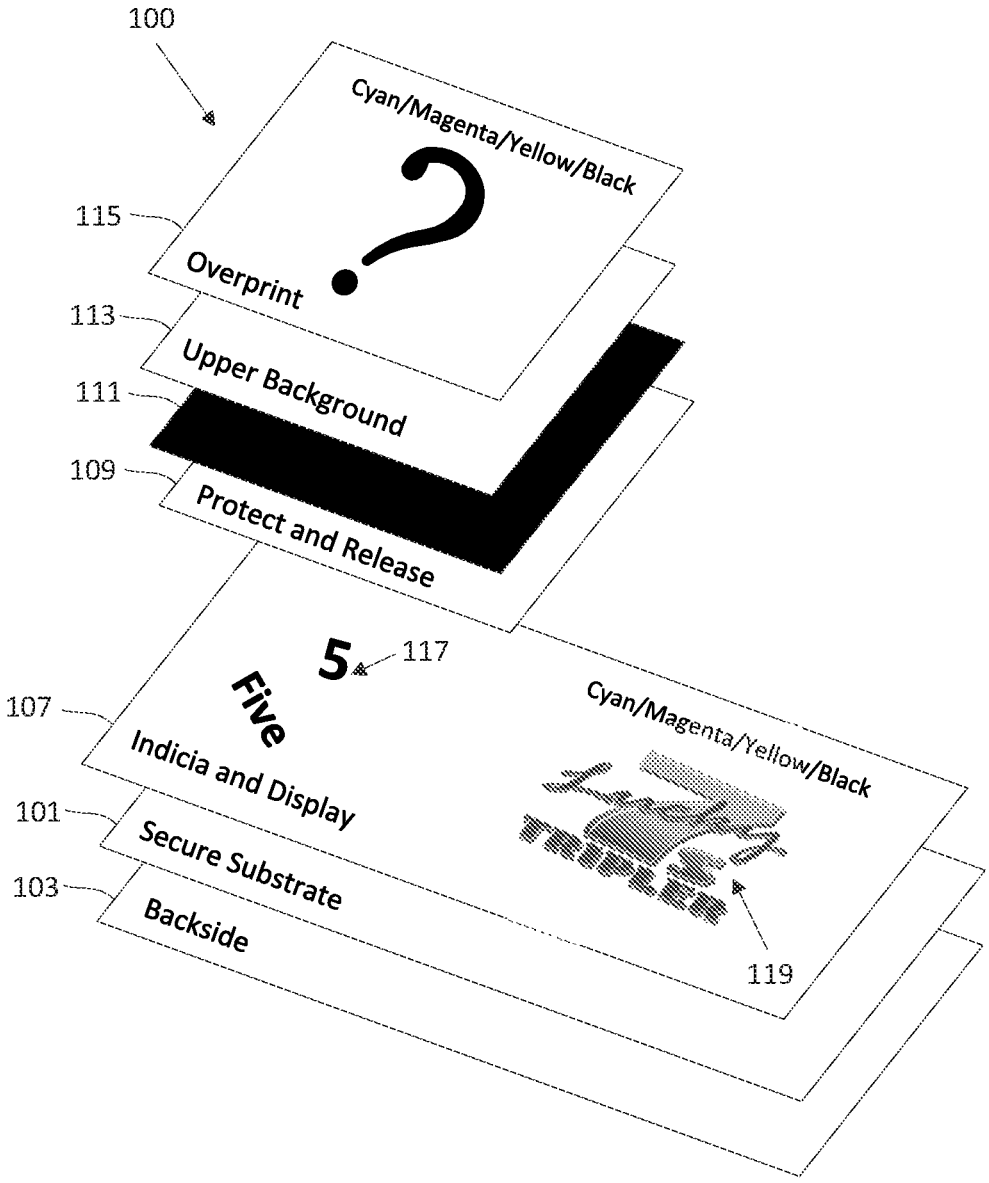
FIG. 1 is a diagram of one embodiment of a scratch-off product with a secure substrate.

FIG. 1 is a diagram illustrating one embodiment of a scratch-off product with a secure substrate. Scratch off-product 100 is printed on a secure substrate 101, which can be comprised of a substrate such as paper, plastic, cardboard, paperboard, foil, synthetic fiber paper, cellulosic material, fibrous material, polymer, film of polyester, polypropylene, or polyvinyl chloride, or combinations thereof, and/or any other suitable material containing security features for protecting hidden indicia 117. Typically, the substrate of a scratch-off product 100 has a thickness of approximately 6 to 12 mils or 0.15 to 0.3 mm. However, any thickness of substrate may be used within the scope of this invention. If the substrate is comprised of a film, polymer or plastic, the substrate may be treated with a primer layer to facilitate adhesion of other layers for secure substrate 101. Alternatively, the primer may be incorporated within the substrate when making the substrate. The substrate may also be modified with a corona or plasma treatment to facilitate the application of other layers to secure substrate 101. It may also be desirable to use primer, corona treatment, and/or plasma treatment for other types of substrate.

Secure substrate 101 is made prior to printing scratch-off product 100. Accordingly, the printing process for scratch-off product 100 is significantly simplified by eliminating the need for print stations that traditionally print the lower security layers.

Secure substrate 101 may include a dark-core substrate (i.e., substrate that incorporates opacifying agents that may be comprised of any combination of various pigments, dyes, colorants and other chemical components) that absorb(s) light in the visible spectrum and the infrared spectrum. In one embodiment, the substrate may be dyed using carbon black and/or a process black that combines magenta, yellow, and cyan (or any other combination of colors) to visually produce the color black. In another embodiment, the substrate may be dyed using any color or combination of colors. The dyed substrate functions as a security barrier to shield against attempts to identify the hidden indicia information 117 from the backside of scratch-off product 100. Alternatively secure substrate 101 may include a white substrate that relies on other security layers to provide opacity, including, for example, lower opacity layers.

Secure substrate 101 may contain one or more lower opacity layers. The lower opacity layer(s) can be applied (e.g., by coating, printing or using any other known method) by using carbon black and/or process black. Alternatively any color or combination of colors can be applied by coating or printing the lower opacity layer(s). Lower opacity layer(s) composed of process black can be applied by layering each of the component color separations. Alternatively, a spot color of process black can be created, which includes the proper proportions of each color, allowing the process black to be applied without layering the colors. The lower opacity layer(s) function as a security barrier to shield against attempts to identify the hidden indicia information 117 from the backside of scratch-off product 100. The lower opacity layer(s) shield against fluorescence and candling by absorbing light and preventing light to pass through the secure substrate 101.

Secure substrate 101 may also contain one or more lower background layers.

Applying the lower background layer(s) above the dyed substrate and/or the lower opacity layer(s) provides a grey or white contrasting background for printing indicia 117. Alternatively, the lower background layer(s) may comprise a color such as magenta, yellow, cyan or any combination thereof. The lower background layer(s) can be applied using anatase or rutile titanium dioxide based white coating or ink. In one embodiment, rutile titanium dioxide is used for the lower background layer(s) to provide enhanced absorption of UV light that may cause fluorescence. Titanium dioxide provides opacity in the visible spectrum by refraction and effectively absorbs ultraviolet light. If any light passes through the lower opacity layer(s), the lower background layer(s) refracts the remaining light (i.e., scatters the light in all directions), causing a portion of the light to be reflected and absorbed by the lower opacity layer(s). The lower background layer(s) can also be comprised of any other coating or ink that is capable of creating a grey, white or colored background. Depending on the degree of contrast required for printing indicia 117, secure substrate 101 may be comprised of multiple background layer(s). In one embodiment, a coating or primer is applied to or incorporated into the lower background layer(s) to facilitate the adhesion of digitally printed images to the background layer(s) using, for example, inkjet, electrophotography and liquid electrophotography printers (or any other type of digital printer). For example, a poly-ethylene acrylic acid solution may be used as primer to facilitate adhesions of inks used for HP Indigo digital printers.

Secure substrate 101 may also contain one or more layers of reflective coating applied above the dyed substrate and/or the lower opacity layer(s) to reduce the thickness of the lower background layer needed to produce the required degree of contrast for printing indicia 117. If a metallic appearance is desired, the layer(s) of reflective coating can serve as the printable background for the indicia 117. Alternatively, the reflective coating layer(s) may be used in place of the lower opacity layer(s).

The lower opacity layer(s), lower background layer(s) and/or reflective coating layer(s) of secure substrate 101 may cover the entirety of secure substrate 101. Although additional coating, ink and/or material is used to cover the entirety of secure substrate 101, (opposed to confining the lower opacity layer(s), lower background layer(s) and/or reflective coating layer(s) to the area where indicia 117 will be printed), this configuration results in a simpler and more efficient process for making secure substrate 101 and ensures secure substrate 101 can be used for any scratch off-product 100 regardless of the shape, size, or location of indicia 117.

In one embodiment, the front side and backside of secure substrate 101 may have substantially the same composition (i.e., the front side and backside surfaces are coated and treated in the same way). In another embodiment, the front side and backside surfaces of secure substrate 101 may have different compositions.

After secure substrate 101 is manufactured, secure substrate 101 can be used for printing scratch-off product 100. Secure substrate 101 is fed into a printing press and indicia 117 and display 119 are printed simultaneously as part of an indicia and display layer 107 on secure substrate 101. No additional security coatings or security layers are required before printing indicia 117 on secure substrate 101. Printing indicia 117 and display 119 at the same time allows the incorporation of indicia 117 in the color separations of display 119. In one embodiment, indicia 117 comprises a color such as magenta, yellow, cyan or any combination thereof (or any other combination of colors) and display 119 comprises different proportions of the same colorant used for indicia 117. Typically display layer 119 is a colored image that may include graphics, instructions for the scratch-off product 100 or other information.

A protect and release layer 109 is printed over indicia and display layer 107 to protect and seal the lower layers and allow all other layers applied on top of the protect and release layer 109 to scratch-off. The protect and release layer 109 can be confined to the area where indicia 117 is printed, or to any portion of the indicia and display area. Alternatively, protect and release layer 109 may be printed to cover all of indicia and display layer 107 (not shown) to streamline the printing process for protect and release layer 109. Printing protect and release layer 109 to cover all of indicia and display layer 107 results in simpler and more efficient printing of scratch-off products 100 as the same flexographic plates and/or gravure cylinders can be used for all scratch-off products 100 regardless of the shape, size or location of indicia 117 on scratch-off product 100. Protect and release layer 109 may also be printed digitally. Protect and release layer 109 is a translucent, scratch resistant, clear coat that may be tinted or colored. Typically, protect and release layer 109 is composed of acrylic or polyurethane along with other additives depending on whether protect and release layer 109 will be dried/cured by convection, ultraviolet light or an electron beam. Protect and release layer 109 can be comprised of any other compound that provides a clear coating that seals and protects the indicia (e.g., from mechanical damage or alteration or from chemical solvents penetrating through protect and release layer 109) and allows the SOC to be scratched off. It may not be preferable to print protect and release layer 109 across all of indicia and display layer 107 if the aesthetic design of scratch-off product 100 does not allow for having a shiny or glossy protect and release layer 109 over display 119.

An upper opacity layer 111 is printed over protect and release layer 109. The colorants in upper opacity layer 111 may be similar in composition to the lower opacity layer(s) of secure substrate 101 and function as a security barrier to shield against attempts to identify the hidden indicia information from the top of scratch-off product 100. Upper opacity layer 111 may contain other materials or an additional layer that works in conjunction with protect and release layer 109 to facilitate removal of upper opacity layer 111 when an individual scratches off the SOC. Upper opacity layer 111 is confined to the area where indicia 117 is printed on scratch-off product 100 so that the upper opacity layer 111 does not cover display 119 printed on indicia and display layer 107. An upper background layer 113 is printed over upper opacity layer 111 to provide a grey, white or colored background for printing overprint layer 115. Upper background layer 113 may be similar in composition and function to the lower background layer(s) of secure substrate 101 but is confined to the area where upper opacity layer 111 is printed so that it does not cover display 119 printed on indicia and display layer 107.

Overprint layer 115 is a colored image printed over upper background layer 113, typically composed of colors such as cyan, magenta, yellow, and black, or any combination thereof (or any combination of other colors). In one embodiment, overprint layer 115 can be printed across some or all of scratch-off product 100, covering upper background layer 113 and some or all of display 119 on indicia and display layer 107 (not shown). In one embodiment, the portion of overprint layer 115 covering some or all of display 119 could comprise additional graphic details for display 119. Alternatively, overprint layer 115 could be a complete reprint of display 119 to provide a continuous appearance to the final printed layer of scratch-off product 100 and conceal all of protect and release layer 109. Concealing all of protect and release layer 109 with a continuous overprint layer 115 would also help secure scratch-off product 100 from any attempted unassisted or assisted mechanical lift by providing a continuous layer that conceals the boundary of the SOC (i.e., layers 111, 113 and 115 in the area covered by protect and release layer 109). Further, a benday pattern consisting of fine lines could be printed across overprint layer 115 (not shown), which would require cutting through and distorting the fine lines to mechanically lift the SOC and identify indicia 117. The distorted lines would indicate that a mechanical lift was attempted.

In one embodiment, display 119 is not printed at the same time as indicia 117, and instead, is printed at the same time as overprint 115. If display layer 119 is printed at the same time as overprint layer 115, upper opacity layer 111 and upper background layer 113 may be printed across the entirety of scratch-off product 100.

A backside layer 103 is printed on the backside of the secure substrate 101. The backside layer is a colored and/or black image that may include graphics, instructions (e.g., game rules, legal disclaimers, redemption instructions, etc.) for the scratch-off product 101, or other information.

In one embodiment, scratch-off product 100 may also include indicia printed on the backside 103 of scratch-off product 100. Accordingly, a protect and release layer, upper opacity layer, upper background layer and overprint layer may also be printed over the indicia on the backside 103 of scratch-off product 100.

The lower opacity layer(s) and lower background layer(s) of secure substrate 101, as well as layers 103, 109, 111, 113 and 115, and display 119 can be applied using a metered size press, a roll coater, a blade coater, a slot-die coater, a curtain coater, a roll printer (e.g., gravure or flexography), any combination thereof, or any other analog or digital method known in the art. Typically, layers 103, 115 and display 119 are printed. Indicia 117 is printed digitally. Colors can be printed using spot colors, any combination of primary colors such as yellow, magenta, cyan and black, or any other combination of colors.

Some or all of the opacity layer(s) of secure substrate 101, backside 103, upper opacity layer(s) 111, overprint layer 115 and display 119 can incorporate colorants having the same or a similar chemical composition as indicia 117 as described in U.S. patent application Ser. No. 15/186,240 entitled "Enhanced Security of Scratch-off Products Using Homogeneous Inks or Dyes," filed on Jun. 17, 2016, incorporated herein by reference in its entirety. Unlike prior art solutions developed to block the use of specific techniques under predefined conditions (e.g., layers that block or attenuate specific solvents known to cause diffusion, layers that block or attenuate specific wavelengths of fluorescent light, and anti-static layers that block or attenuate electrostatic charge) to view indicia 117, the embodiments described in U.S. patent application Ser. No. 15/186,240 effectively protect against known and unknown techniques to view indicia 117 by causing the indicia 117 to emit signals that are the same or similar to the signals generated by other portions of the scratch-off product 100.

The secure substrate 101 can be designed to provide a specific opacity by formulating the various layers of the secure substrate 101 to meet the opacity requirements of a particular scratch-off product 100. The opacity of secure substrate 101 can be designed and measured using principles of spectrophotometry and tools such as a transmission densitometer. A transmission densitometer measures the transmittance of a material and identifies the optical density of the material. Transmittance is the fraction of light that passes through a material and is defined as the ratio of the light energy transmitted through the material to the light energy incident on the material (i.e. T=VI0). If all light is transmitted through the material, the transmittance is one, and if no light is transmitted through the material, the transmittance is zero. Transmission optical density is logarithmically related to transmittance and is defined by the equation OD=−logio T. Accordingly, a one unit change in optical density indicates a factor of ten change in the transmittance (e.g. an optical density of 1 correlates to a transmittance of 0.1 or 90 percent opacity, whereas an optical density of 2 correlates to a transmittance of 0.01 or 99 percent opacity). In some cases, the chemical compounds used for providing opacity may result in the material effectively blocking light of a particular set of wavelengths but allowing the transmission of other wavelengths. Because different pigments, dyes, and other chemical compounds absorb different wavelengths of light, the opacifying agents incorporated in substrate 101 may be comprised of any combination of various pigments, dyes, colorants and other chemical components to ensure that a broad spectrum of wavelengths of light are absorbed by the opacifying agents.

Using these principles, the types of coating or ink, the type of pigment or dye (e.g., carbon black, process black, yellow, cyan, magenta, any combination thereof, any other color or any other combination of colors), and the concentration of the colorant (i.e., the amount of colorant used in the coating or ink) for the various layers of secure substrate 101 can be designed to provide the necessary opacity. For example, if the required transmission optical density of secure substrate 101 is 3.5 or greater, the layers of secure substrate 101 will be designed to meet the required opacity without unnecessarily using an excessive concentration of colorant or excessive amounts of the of coating or ink for coating or printing the lower opacity layer(s). This approach ensures that the printed scratch-off product does not unnecessarily exceed the required transmission optical density. Further, additional savings may be realized by reducing the amount of coating or ink needed for the lower background layer(s) to cover the lower opacity layer(s) and provide the required white, grey or colored printable background for the remainder of scratch-off product 100. In one embodiment, the transmission optical density of secure substrate 101 is at least 3.5 and may be as high as 4.5 or greater, depending on the security requirements of the application. The transmission optical density of secure substrate 101 can be measured using a transmission densitometer or opacity meter, including, for example, commercially-available instruments such as the TBX1000/1500 and TBS2000 of Tobias Associates, Inc. (Ivyland, Md.).

Figure 2:
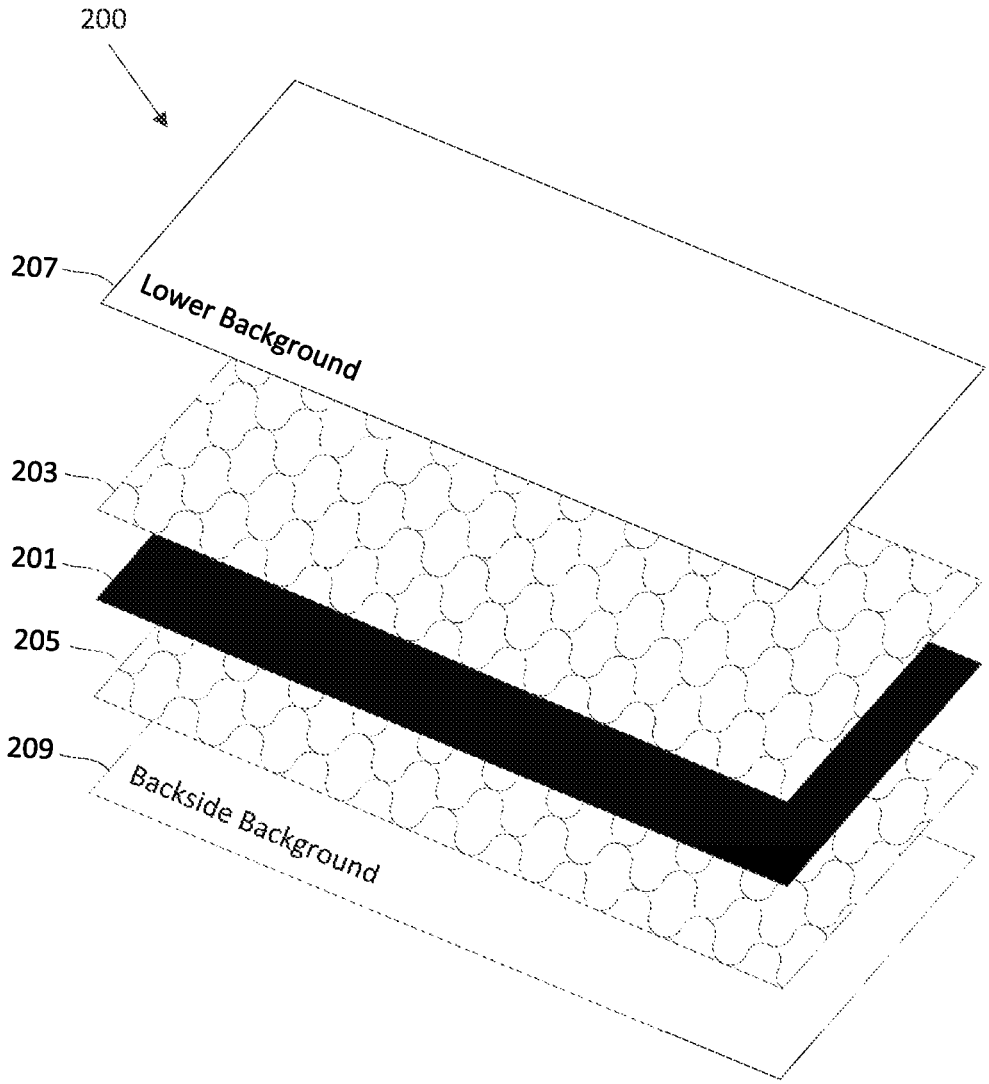
FIG. 2 is a diagram of one embodiment of a secure substrate.

FIG. 2 is a diagram illustrating one embodiment of a secure substrate 200. Secure substrate 200 is comprised of substrate 201 such as paper, plastic, cardboard, paperboard, foil, synthetic fiber paper, cellulosic material, fibrous material, polymer, film of polyester, polypropylene, or polyvinyl chloride, combinations thereof, and/or any other suitable material for printing scratch-off products. Typically, substrate 201 has a thickness of approximately 6 to 12 mils or 0.15 to 0.3 mm. However, any thickness of substrate may be used within the scope of this invention. If the substrate is comprised of a film, polymer or plastic, substrate 201 may be treated with a primer layer to facilitate adhesion of other layers for secure substrate 200.

Substrate 201 may also be modified with a corona or plasma treatment to facilitate the application of other layers to secure substrate 200. It may also be desirable to use primer, corona treatment, and/or plasma treatment for other types of substrate.

Substrate 201 is dyed using one or more colorants that absorb(s) light in the visible spectrum and the infrared spectrum. Substrate 201 can be dyed by adding colorant to the mixture used for manufacturing substrate 201 (e.g., paper pulp that is used for paper substrate or a resin/polymer mixture that is used for film substrate). In one embodiment, the substrate 201 may be dyed using colorant that is comprised of carbon black and/or a process black that combines magenta, yellow, and cyan (or any other combination of colors) to visually produce the color black. In another embodiment, the substrate may be dyed any color or combination of colors. In a preferred embodiment, the dye used for substrate 201 is colorant that is comprised of both carbon black and process black, effectively providing an opacity layer that contains a combination of colorants that may be used for the indicia of a scratch-off product. The dye penetrates the entire thickness of substrate 201. The dyed substrate functions as a security barrier to shield against attempts to identify hidden indicia information from the backside of a scratch-off product. Because the dye penetrates the entire thickness of the substrate 201, the opacity of substrate 201 is a function of the thickness of the substrate in combination with the type and concentration of colorant used to dye the substrate 201. If substrate 201 is delaminated into two pieces having half the thickness as the original substrate 201, each piece will have approximately half the opacity as the original substrate 201.

Microperforations 203 and 205 are applied to the top and bottom surfaces of substrate 201 in the form of indentations, cuts, slits or perforations that intersect one another and extend across the surface of the substrate 201. Microperforations 203 and 205 are typically on the order of 1 mil thick, but can vary in thickness depending upon the requirements of a particular scratch-off product. Any thickness of microperforations falls within the scope of this invention. Microperforations 203 and 205 can be applied using laser ablation, die cutting, or any other known method for applying perforations. Elements 203 and 205 in FIG. 2 show the patterns of microperforations that are applied to the top and bottom surfaces, respectively, of the substrate 201. The patterns of microperforations on the top and bottom surfaces may be the same or different. The pattern of microperforations on the top surface can be aligned or offset with respect to the pattern of microperforations on the bottom surface.

The microperforations 203 and 205 provide protection against attempts to delaminate substrate 201, and effectively stop individuals from reducing the opacity of substrate 201 to identify the hidden indicia of a scratch-off product via candling. If delamination is attempted, the microperforations 203 and 205 will cause the substrate to break into pieces along the shape of the perforations or crumble into the shapes defined by the microperforations making it difficult to glue the various pieces of the delaminated substrate to conceal the delamination. Microperforations 203 and 205 must penetrate substrate 201 to a depth that is sufficient to ensure that the substrate 201 breaks into pieces during an attempted delamination but must not compromise the strength of substrate 201 for normal use with scratch-off products. In one embodiment, microperforations 203 and 205 penetrate substrate 201 to a combined depth that is less than half the thickness of substrate 201. Because different applications may require microperforations of different depths, any depth of microperforations falls within the scope of this invention. In one embodiment, if the depth of microperforations 203 and 205 compromise the strength of substrate 201, a thin film or glue may be applied to substrate 201 to maintain the structural integrity of substrate 201 without changing the function of microperforations 203 and 205 for resisting attempted delamination.

In one embodiment, microperforations may be applied to only one side of the substrate 201 (not shown). Microperforations 203 and 205 may be placed any distance apart, may be any shape or variety of shapes (e.g., square, triangle, arcuate or random), and may have any number of intersections across the entirety of the substrate.

Secure substrate 200 contains one or more lower background layer(s) 207 applied over microperforations 203 and one or more backside background layer(s) 209 applied over microperforations 205. Coating or printing the background layers 207 and 209 over the dyed substrate provides a grey or white contrasting background for printing scratch-off products. Alternatively, the background layers 207 and 209 may comprise a color such as magenta, yellow, cyan or any combination thereof. The background layers 207 and 209 can be applied using anatase or rutile titanium dioxide based white coating or ink. Titanium dioxide provides opacity in the visible spectrum by refraction and effectively absorbs ultraviolet light. In one embodiment, rutile titanium dioxide is used to provide better absorption of UV light that may cause fluorescence. If any light passes through substrate 201, lower background layer 207 and/or backside background layer 209 refracts the remaining light, causing a portion of the light to be reflected and absorbed by substrate 201. The background layers 207 and 209 can also be comprised of any other coating or ink that is capable of creating a grey, white or colored background. Depending on the degree of contrast required for printing a scratch-off product, lower background layer 207 and/or backside background layer 209 may be comprised of multiple layers. In one embodiment, a coating or primer is applied to or incorporated into the lower background layers 207 and 209 to facilitate the adhesion of digitally printed images using, for example, inkjet, electrophotography and liquid electrophotography printers (or any other type of digital printer). For example, a poly-ethylene acrylic acid solution may be used as primer to facilitate adhesions of inks used for HP Indigo digital printers.

Applying background layer(s) 207 and 209 over microperforations 203 and 205 helps conceal the microperforations. In one embodiment, lower background layer 207 and backside background layer 209 may be applied directly to substrate 201 and microperforations 203 and 205 may be applied to the lower background layer 207 and the backside background layer 209 (not shown). In this embodiment, microperforations 203 and 205 may be visible from the front side and backside of a scratch-off product unless other layers are printed across the entirety of secure substrate 200 to hide microperforations 203 and 205.

If secure substrate 200 must have a specific transmission optical density for a particular scratch-off product, the transmission optical density can be achieved by manipulating the thickness of the substrate 201 and the concentration of the colorant for dying substrate 201. For example, the transmission optical density of substrate 201 can be approximately doubled by either doubling the thickness of substrate 201 or doubling the concentration of the colorant used to dye substrate 201. Alternatively, the same transmission optical density of substrate 201 can be maintained by halving the thickness of substrate 201 and doubling the concentration of the colorant used to dye substrate 201. The transmission optical density of secure substrate 200 can be further tuned by changing the amount of titanium dioxide (i.e., changing the thickness of the titanium dioxide layer or the concentration of titanium dioxide in the coating or ink) used to coat or print lower background layer 207 and/or backside background layer 209. If any light passes through substrate 201, the amount of titanium dioxide used for the lower background layer 207 and the backside background layer 209 will affect the opacity contributed by these layers (e.g., by refracting light in the visible spectrum and absorbing ultraviolet light). In one embodiment, dyed substrate 201 is comprised of 8 mil thick paper that is dyed using 0.5 percent by weight carbon black pigment (i.e., 5 lbs. carbon black pigment per 1,000 pounds paper), resulting in a transmission optical density of approximately 3.8. In another embodiment, lower background layers 207 and 209 are comprised of a 1 mil thick conventional white paper coating with 20% of the pigment content replaced by rutile titanium dioxide, which increases the transmission optical density of secure substrate 200 in the previous embodiment from 3.8 to 4.0.

The pattern of microperforations 203 and 205 may extend across the entirety of the substrate 201, and the lower background layer 207 and the backside background layer 209 cover the entirety of substrate 201. Although additional coating, ink and/or material is used to cover the entirety of substrate 201, this configuration ensures secure substrate 200 can be used for printing any scratch off-product regardless of the shape, size, or location of the hidden indicia for different scratch-off products.

After secure substrate 200 is manufactured, secure substrate 200 can be used for printing any scratch-off product. Secure substrate 200 can be fed into a printing press and the indicia and upper layers of a scratch-off product can be printed directly on secure substrate 200 (as described with respect to FIG. 1), without requiring any additional lower security coatings or lower security layers.

Figure 3:
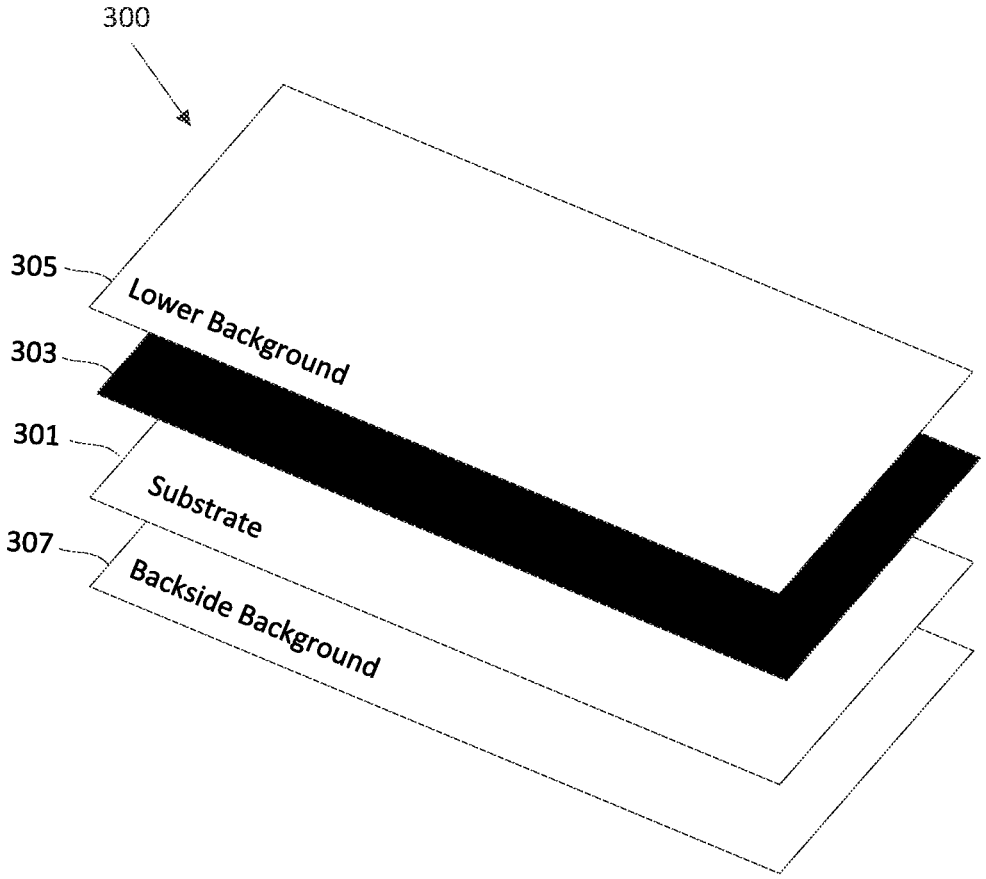
FIG. 3 is a diagram of one embodiment of a secure substrate.

FIG. 3 is a diagram illustrating one embodiment of a secure substrate 300. Secure substrate 300 is comprised of substrate 301 such as paper, plastic, cardboard, paperboard, foil, synthetic fiber paper, cellulosic material, fibrous material, polymer, film of polyester, polypropylene, or polyvinyl chloride, combinations thereof, and/or any other suitable material for printing scratch-off products. Typically, substrate 301 has a thickness of approximately 6 to 12 mils or 0.15 to 0.3 mm. However, any thickness of substrate may be used within the scope of this invention. If the substrate is comprised of a film, polymer or plastic, substrate 301 may be treated with a primer layer to facilitate adhesion of other layers for secure substrate 300.

Substrate 301 may also be modified with a corona or plasma treatment to facilitate the application of other layers to secure substrate 300. It may also be desirable to use primer, corona treatment, and/or plasma treatment for other types of substrate.

A lower opacity layer 303 is applied (e.g., by coating, printing, or using any other known method) on substrate 301. The lower opacity layer may comprise a carbon black based coating or ink or can be process black. Alternatively any color or combination of colors can be used to coat or print the lower opacity layer 303. A lower opacity layer 303 composed of process black can be applied by layering each of the component color separations. Alternatively, a spot color of process black can be created, which includes the proper proportions of each color, allowing the process black to be printed without layering the colors. Lower opacity layer 303 may be comprised of a single layer or multiple layers, including for example, one layer of carbon black and one layer of process black (or any other combination of colors and layers). In a preferred embodiment, lower opacity layer 303 is comprised of one or more layers of carbon black and one or more layers of process black, effectively providing an opacity layer that contains a combination of colorants that may be used for the indicia of a scratch-off product. The lower opacity layer 303 functions as a security barrier to shield against attempts to identify the hidden indicia information from the backside of a scratch-off product. The lower opacity layer 303 shields against fluorescence and candling by absorbing light and preventing light to pass through secure substrate 300.

Because the lower opacity layer 303 does not penetrate the substrate 301, the opacity of secure substrate 300 is a function of the thickness of the lower opacity layer 303 (i.e., the thickness of coating or ink that comprises the lower opacity layer) and the concentration of the colorant used in the coating or ink (i.e., the amount of colorant in the coating or ink) to coat lower opacity layer 303. Lower opacity layer 303 can be significantly thinner than the dyed substrate 201 of FIG. 2. Accordingly, the concentration of the colorant used for lower opacity layer 303 must be significantly greater than the concentration of the colorant used for dyed substrate 201 to provide the same opacity as the dyed substrate 201. However, unlike the dyed substrate 201, if substrate 301 is delaminated into two pieces having half the thickness as the original substrate 301, the opacity of secure substrate 300 remains the same as the lower opacity layer 303 will remain intact below the indicia printed on a scratch-off product.

In one embodiment, the opacity provided by lower opacity layer 303 for secure substrate 300 can allow a scratch-off product manufacturer to use less coating or ink for upper opacity layer 111 of FIG. 1. For example, if lower opacity layer 303 provides sufficient opacity to resist candling and fluorescence from the backside of the scratch-off product (or other compromise techniques that rely on transmission of light through the backside of a scratch-off product), upper opacity layer 111 only needs to provide sufficient opacity to resist fluorescence from the front side of the scratch-off product (or other compromise techniques that rely on reflection of light through the front side of a scratch-off product). That means, upper opacity layer 111 can be thinner than lower opacity layer 303 and/or the concentration of the colorant in the coating or ink for upper opacity layer 111 can be less dense than the concentration of the colorant in the coating or ink used for lower opacity layer 303. Further, if a white upper background layer 113 is desired, less titanium dioxide is needed to cover a lower concentration (i.e., less dark) upper opacity layer 111. Accordingly, the design of secure substrate 300 can reduce the cost and difficulty of printing secure scratch-off products.

A lower background layer 305 is applied on lower opacity layer 303. Coating or printing lower background layer 305 over lower opacity layer 303 provides a grey or white contrasting background for printing a scratch-off product. Alternatively, lower background layer 305 may comprise a color such as magenta, yellow, cyan or any combination thereof. If a white or grey background is desired, lower background layer 305 can be applied using anatase or rutile titanium dioxide based white coating or ink. In one embodiment, rutile titanium dioxide is used for the lower background layer 305 to provide better absorption of UV light that may cause fluorescence. Titanium dioxide provides opacity in the visible spectrum by refraction and effectively absorbs ultraviolet light. If any light passes through lower opacity layer 303, lower background layer 305 refracts the remaining light, causing a portion of the light to be reflected and absorbed by lower opacity layer 303. Lower background layer 305 can also be comprised of any other coating or ink that is capable of creating a grey, white or colored background.

Depending on the degree of contrast required for printing a scratch-off product, lower background layer 305 may be comprised of multiple layers. In one embodiment, a coating or primer is applied to or incorporated into the lower background layer 305 to facilitate the adhesion of digitally printed images to secure substrate 300 using, for example, inkjet, electrophotography and liquid electrophotography printers (or any other type of digital printer). For example, a poly-ethylene acrylic acid solution may be used as primer to facilitate adhesions of inks used for HP Indigo digital printers.

A backside background layer 307 is applied over substrate 301. In one embodiment, backside background layer 307 is comprised of any color or combination of colors to provide a contrasting background to print the backside of scratch-off products. In another embodiment, a backside opacity layer (not shown) that may be similar in function and composition to lower opacity layer 303 may be applied on the backside of substrate 301. In this embodiment, backside background layer 307 may be similar in function and composition to lower background layer 305. In one embodiment, a coating or primer is applied or incorporated into backside background layer 307 to facilitate the adhesion of digitally printed images to secure substrate 300 using, for example, inkjet, electrophotography and liquid electrophotography printers (or any other type of digital printer). For example, a poly-ethylene acrylic acid solution may be used as primer to facilitate adhesions of inks used for HP Indigo digital printers.

If secure substrate 300 must have a specific transmission optical density for a particular scratch-off product, the transmission optical density can be achieved by changing the thickness of the lower opacity layer 303 and/or the concentration of the colorant in the coating or ink used for coating or printing lower opacity layer 303. For example, the transmission optical density of secure substrate 300 can be approximately doubled by either doubling the thickness of lower opacity layer 303 or doubling the concentration of the colorant used in the coating or ink for lower opacity layer 303. Alternatively, the same transmission optical density of secure substrate 300 can be maintained by halving the thickness of the lower opacity layer 303 and doubling the concentration of the colorant in the coating or ink used for lower opacity layer 303. In one embodiment, secure substrate 300 comprises an about 1 mil thick lower opacity layer 303 that uses a coating containing about 2.5 percent by weight carbon black (i.e., 2.5 lbs. carbon black pigment per 100 lbs. of coating), which contributes a transmission optical density of 3.8 to the secure substrate 300.

The transmission optical density of secure substrate 300 can be further tuned by changing the amount of titanium dioxide (i.e., changing the thickness of the titanium dioxide layer or the concentration of titanium dioxide in the coating) used for the lower background layer 305. Because increasing the concentration of the colorant used for lower opacity layer 303 will require significantly more titanium dioxide to provide a white background layer 305 for printing scratch-off products, other methods of increasing the transmission optical density of secure substrate 300 may be preferred. In another embodiment, secure substrate 300 comprises a 1 mil thick lower background layer 305 using a conventional white paper coating with 20% of the pigment content replaced by rutile titanium dioxide, which increases the transmission optical density of secure substrate 300 in the previous embodiment from 3.8 to 4.0.

In one embodiment, lower opacity layer 303 is comprised of a thick layer of low concentration colorant (e.g., yielding a grey lower opacity layer 303) to provide the necessary opacity for scratch-off product 300. In this embodiment, less titanium dioxide coating or ink is required to provide a white background than if the desired transmission optical density is achieved using a thin layer of high concentration colorant (e.g., yielding a dark black lower opacity layer 303).

In one embodiment the transmission optical density of secure substrate 300 is increased by applying (e.g., coating, printing or using any other known method) an additional opacity layer (not shown) over lower background layer 305 and an additional background layer (not shown) over the additional opacity layer. This configuration of lower opacity layer 303, lower background layer 305, additional opacity layer and additional lower background layer allows for an increase in opacity while using significantly less coating or ink for each of the layers. To the extent any light is not absorbed by the lower opacity layer 303, the lower background layer 305 absorbs ultraviolet light and refracts visible light. The lower opacity layer 303 then absorbs a portion of the refracted visible light that is reflected by the lower background layer 305. Any light that passes through the lower background layer 305 is then absorbed by the additional opacity layer (not shown). To the extent any light is not absorbed by the additional opacity layer, the additional background layer absorbs ultraviolet light and refracts visible light. The additional opacity layer then absorbs a portion of the refracted visible light that is reflected by the additional background layer. Any number of opacity layers and background layers can be used for secure substrate 300 within the scope of this invention.

Lower opacity layer 303, lower background layer 305, backside background layer 307, and any other layers that comprise secure substrate 300 cover the entirety of substrate 301. Although additional coating, ink and/or material is used to cover the entirety of substrate 301, this configuration ensures secure substrate 300 can be used for printing any scratch off-product regardless of the shape, size, or location of the hidden indicia for different scratch-off products.

After secure substrate 300 is manufactured, secure substrate 300 can be used for printing any scratch-off product. Secure substrate 300 can be fed into a printing press and the indicia and upper layers of a scratch-off product can be printed directly on secure substrate 300 (as described with respect to FIG. 1), without requiring any additional lower security coatings or lower security layers.

Figure 4:
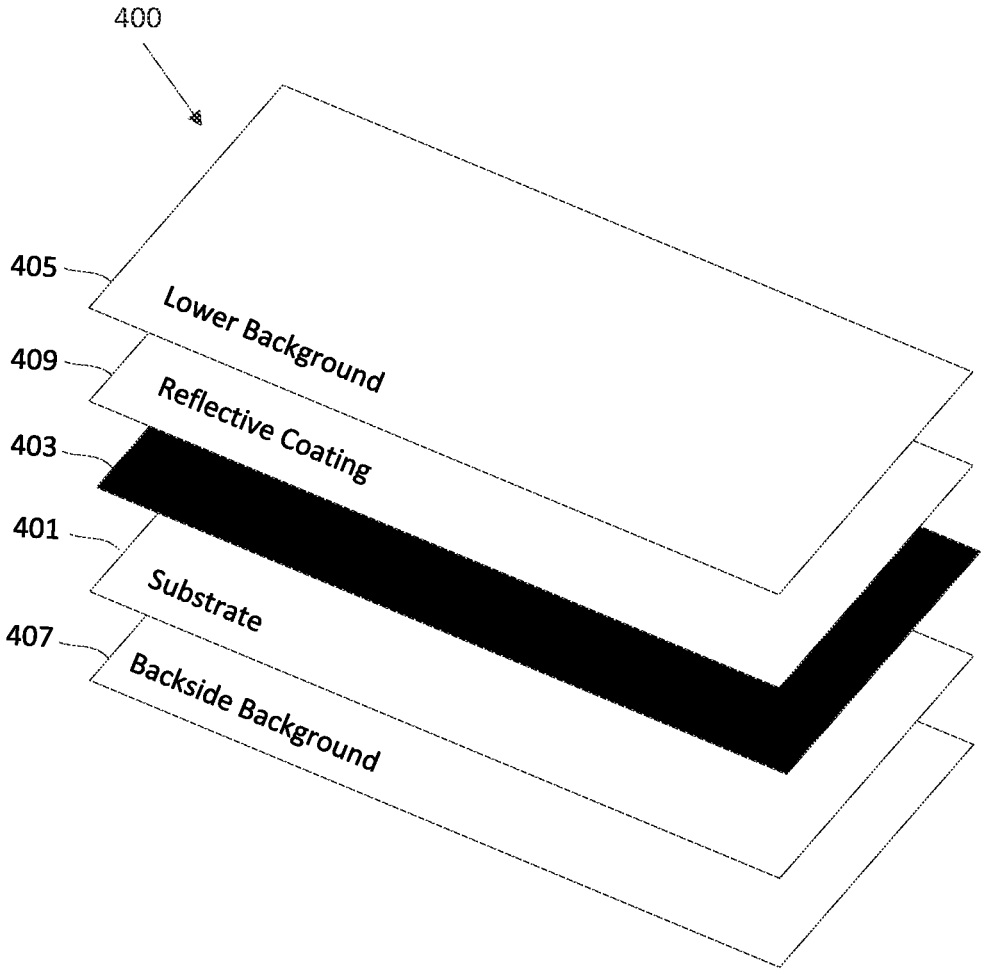
FIG. 4 is a diagram of one embodiment of a secure substrate.

FIG. 4 is a diagram illustrating one embodiment of a secure substrate 400. Substrate 401, lower opacity layer 403, lower background layer 405 and backside background 407 of FIG. 4 are similar in composition and function to substrate 301, lower opacity layer 303, lower background layer 305 and backside background layer 307.

A reflective coating 409 is applied over lower opacity layer 403. Reflective coating 409 can be comprised of foil laminated to lower opacity layer 403 or can be a thin layer that is applied to lower opacity layer 403 using various metallization techniques, including, for example, vacuum metallization (i.e., vaporizing aluminum by heating aluminum in a low pressure chamber causing the vaporized aluminum to transfer to a substrate), film metallization (i.e., applying a film with a thin layer of vacuum metalized aluminum to a substrate) or transfer metallization (i.e., transferring vacuum metalized aluminum from a film having a release liner coating to a substrate). Due to the porous nature of paper, vacuum metallization may require a significant amount of vaporized aluminum to create reflective coating 409. Similarly, foil lamination for reflective coating 409 typically requires use of a thick foil layer that typically has a thickness of at least 50 μm. Both foil lamination and vacuum metallization result in the use of a significant amount of metal, which may render the secure substrate 400 unrecyclable. In a preferred embodiment, reflective coating 409 is applied as a very thin layer, typically on the order of about 1-2 μm (or less), using film metallization or transfer metallization. Use of transfer metallization for reflective coating 409 may allow secure substrate 400 to be recyclable (e.g., Hazen's Envirofoil).

In addition to aesthetics, reflective coating 409 also provides additional opacity that shields against fluorescence and candling from the back side of secure substrate 400 by reflecting any light that passes through lower opacity layer 403. Further, reflective coating 409 conceals lower background layer 403 from the front side of secure substrate 400, requiring significantly less opaque white coating to produce a white lower background layer 405 than if reflective coating 409 was not applied over lower opacity layer 403.

In one embodiment, a white or colored lower background layer 409 may not be required, and instead, a shiny surface may be desired for printing scratch-off products.

Accordingly, reflective coating 409 may be primed to allow direct printing of digital images as discussed in previous embodiments. In another embodiment, lower background layer 405 may cover select portions of reflective coating 409 to retain a shiny surface on select portions of secure substrate 400. In one embodiment, the reflective coating 409 applied to lower opacity layer 403 may include holographic images.

If secure substrate 400 must have a specific transmission optical density for a particular scratch-off product, the transmission optical density can be achieved by changing the thickness of the lower opacity layer 403, the concentration of the colorant used in the coating or ink for coating or printing lower opacity layer 403 and the thickness or reflectivity of reflective coating 409. For example, the transmission optical density of secure substrate 400 can be approximately doubled by either doubling the thickness of lower opacity layer 403 or doubling the concentration of the colorant used in the coating or ink for lower opacity layer 403. In one embodiment, secure substrate 400 comprises an about 1 mil thick lower opacity layer 403 that uses a coating containing about 2.5 percent by weight carbon black (i.e., 2.5 lbs. carbon black pigment per 100 lbs. of coating), which contributes a transmission optical density of 3.8 to the secure substrate 400.

The transmission optical density of secure substrate 400 can be further increased by increasing the thickness or reflectivity of reflective coating 409. A thin layer of reflective coating 409 provides opacity by reflecting light. A thicker layer of reflective coating 409 provides the same reflection characteristics as a thinner reflective coating 409 but also provides additional opacity by absorbing light that is not reflected. The reflectivity of the coating will also affect the reflection characteristics as a shiny reflective coating will reflect more light than a dull reflective coating. The transmission optical density of secure substrate 400 can be further tuned by changing the amount of titanium dioxide (i.e., changing the thickness of the titanium dioxide layer or the concentration of titanium dioxide in the coating or ink) used for the lower background layer 407. In this embodiment, increasing the thickness of lower opacity layer 403 and/or doubling the concentration of the colorant used in the coating or ink for lower opacity layer 403 will not require additional titanium dioxide to provide a white background layer 407 as reflective coating 409 conceals lower background layer 403. In one embodiment, secure substrate 400 comprises a 1 micron thick reflective coating 409 applied via transfer metallization, which contributes an additional transmission optical density of 1.2 to the transmission optical density provided by the lower opacity layer 403. In this embodiment, the 1 micron thick reflective coating 409 is comprised of a 30 nanometer thick layer of metalized aluminum and a 970 nanometer thick coating that protects the metalized aluminum and facilitates application of the lower background layer 405 or any other layer to reflective coating 409.

In one embodiment the transmission optical density of secure substrate 400 is increased by applying (e.g., by coating, printing or using any other known method) a lower background layer and an additional lower opacity layer (not shown) over lower opacity layer 403, before applying reflective coating 409. Lower opacity layer 403, backside background layer 407, and reflective coating 409 may cover the entirety of substrate 401. Although additional coating, ink and/or material is used to cover the entirety of substrate 401, this configuration ensures secure substrate 400 can be used for printing any scratch off-product regardless of the shape, size, or location of the hidden indicia for different scratch-off products.

After secure substrate 400 is manufactured, secure substrate 400 can be used for printing any scratch-off product. Secure substrate 400 can be fed into a printing press and the indicia and upper layers of a scratch-off product can be printed directly on secure substrate 400 (as described with respect to FIG. 1), without requiring any additional lower security coatings or lower security layers.

Figure 5:
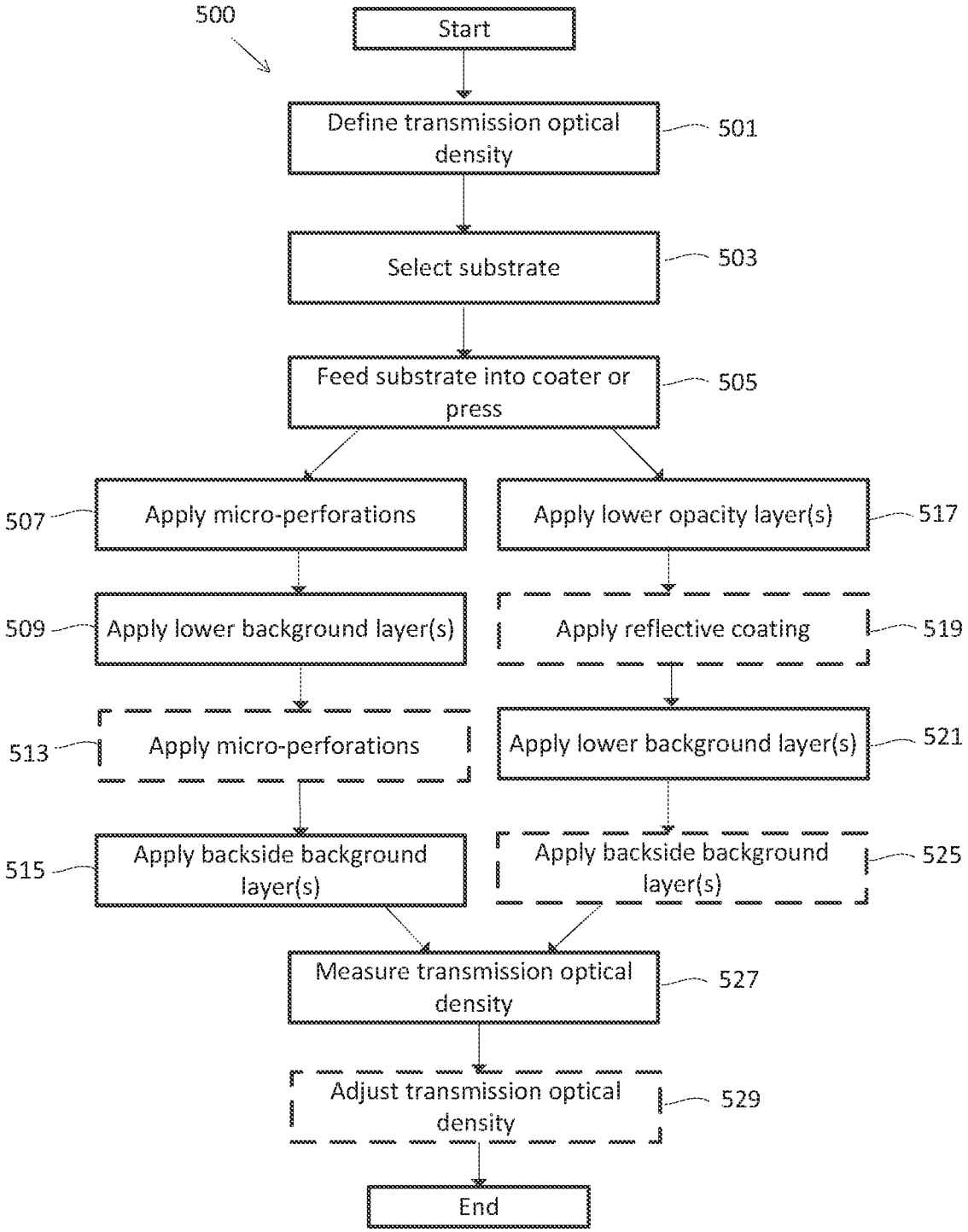
FIG. 5 is a flowchart of steps for making a secure substrate.

FIG. 5 is a flowchart of steps 500 for making a secure substrate. At step 501, the manufacturer of a secure substrate defines the transmission optical density for secure substrate 101, 200, 300 or 400. At step 503, the type of substrate 201, 301 or 401 is selected for manufacturing secure substrate 200, 300 or 400. If a dyed substrate 201 is selected, the manufacturer can select from different thicknesses of the substrate 201 and different concentrations of colorant used to dye substrate 201 as factors for meeting the defined transmission optical density of secure substrate 200. In a preferred embodiment, the colorant used to dye substrate 201 is comprised of carbon black and process black, effectively masking a range of colors that may be used for printing the hidden indicia of a scratch-off product. At step 505, substrate 201, 301 or 401 is fed into a coater or printer comprised of one or more stations for coating or printing the various layers of a secure substrate, including, for-example, secure substrate 200, 300 and 400 described with respect to FIGS. 2, 3 and 4 above. In a preferred embodiment, the coating stations are in line with the paper machine used to produce the substrate.

If the substrate selected at step 503 and fed into the coater or printer at step 505 is a dyed substrate 201, the method steps proceed from step 505 to step 507. At step 507, microperforations 203 are applied to the front side of substrate 201 to resist an attempt to reduce the opacity of the dyed substrate 201 by delamination. Microperforations 203 are applied by laser ablation, dye cutting or any other known method for applying perforations. At step 509, the lower background layer 207 is applied (e.g., by coating, printing or using any other known method) over microperforations 203 in substrate 201, and may be comprised of white or colored coating. The thickness of the coating or ink layer and the concentration of the coating or ink used for lower background layer 207 may be selected as factors contributing to the transmission optical density of secure substrate 200 and for their ability to provide a white background above the dyed substrate 201. At step 513 microperforations 205 are applied to the back side of substrate 201. At step 515, backside background layer 209 is applied over microperforations 205 in substrate 201, which may be comprised of white or colored coating. The thickness of the coating or ink and the concentration of the coating or ink used for backside background layer 209 may be selected as factors contributing to the transmission optical density of secure substrate 200. The order of operations 507, 509, 513, and 515 may vary depending on factors including the available equipment configuration and whether the perforations will be hidden with coating.

In one embodiment, the combined depth of microperforations 203 and 205 do not exceed half the thickness of substrate 201 or do not exceed a depth that allows for using secure substrate 200 for scratch-off products. In another embodiment, any depth of microperforations may be applied. If the depth of the microperforations weakens substrate 201, a thin film or glue may be applied to provide additional structural integrity to substrate 201 without compromising the function of the microperforations for resisting an attempted delamination. In one embodiment, only microperforations 203 are applied to substrate 201. In this embodiment, step 513 does not need to be performed and the method steps proceed from step 509 directly to step 515.

At step 527 the transmission optical density of secure substrate 200 can be measured to verify that the secure substrate 200 meets or exceeds the transmission optical density defined at step 501. If secure substrate 200 does not meet the transmission optical density defined at step 501, at step 529 the transmission optical density of secure substrate 200 is adjusted by adding additional thickness to lower background layer 207, adding additional thickness to backside background layer 209, and/or by applying (e.g., by coating, printing or using any other known method) an additional opacity layer above lower background layer 207 and an additional background layer above the additional opacity layer. Alternatively, the thickness of substrate 201, the concentration of colorant used to dye substrate 201, the thickness of lower background layers 207 and/or 209, and/or the concentration of opacifying agents used for lower background layers 207 and/or 209 may be adjusted to ensure that further production of scratch-off products 200 meet the defined transmission optical density. If secure substrate 200 meets or exceeds the defined transmission optical density at step 527, method step 529 is not performed and the method steps end at step 527.

If the substrate selected at step 503 and fed into the coater or printer at step 505 is a substrate 301 or 401, the method steps proceed from step 505 to step 517. At step 517, lower opacity layer 303 or 403 is applied to substrate 301 or 401. The thickness of the lower opacity layer 303 or 403 and or the concentration of the colorant used in the coating or ink for the lower opacity layer 303 or 403 are selected as factors contributing to the defined transmission optical density of secure substrate 300 or 400. In a preferred embodiment, the colorant used for lower opacity layer 303 or 403 is comprised of carbon black and process black, effectively masking a range of color that may be used for printing the hidden indicia of a scratch-off product. In a preferred embodiment, lower opacity layers 303 or 403 are applied inline on the paper machine producing substrate 301 or 401.

In one embodiment, at step 519, a reflective coating 409 may be applied over lower opacity layer 403 via film metallization or transfer metallization. The thickness of reflective coating 409 may be selected as a factor contributing to the transmission optical density of secure substrate 400. At step 521, a lower background layer 405 is printed over reflective coating 409, which may be comprised of white or colored coating or ink. The thickness of the coating or ink layer or concentration of opacifying agents used for lower background layer 405 may be selected as factors contributing to the transmission optical density of secure substrate 400. In another embodiment, step 519 is not performed and the method steps proceed directly from step 517 to step 521. At step 521, a lower background layer 305 is applied (e.g., by coating, printing or using any other known method) over lower opacity layer 303, which may be comprised of white or colored coating. The thickness of the coating layer and the concentration of opacifying agents used for lower background layer 305 may be selected as factors contributing to the transmission optical density of secure substrate 300.

At step 525 backside background layer 307 or 407 is applied on substrate 301 or 401, which may be comprised of white or colored coating. The thickness of the coating or ink layer and the concentration of opacifying agents used for backside background layer 307 or 407 may be selected as factors contributing to the opacity of secure substrate 300 or 400. In one embodiment, step 525 is not performed as the backside of substrate 301 or 401 is suitable for printing digital images without coating a backside background layer 307 or 407. In this embodiment, the method steps proceed directly from step 521 to step 527.

At step 527, the transmission optical density of secure substrate 300 or 400 can be measured to verify that the secure substrate 300 or 400 meets or exceeds the transmission optical density defined at step 501. If secure substrate 300 or 400 does not meet the transmission optical density defined at step 501, at step 529 the transmission optical density of secure substrate 300 or 400 is adjusted by adding additional ink or coating to lower background layer 305 or 405, adding additional ink or coating to backside background layer 307 or 407, and/or by printing or coating an additional opacity layer above lower background layer 305 or 405 and an additional background layer above the additional opacity layer. In another embodiment, the thickness of the lower opacity layer 303 or 403, the concentration of the colorant used for the coating or ink of lower opacity layer 303 or 403, the thickness of lower background layers 305 or 405 and/or backside background layers 307 or 407, the concentration of opacifying agents used for lower background layers 305 or 405 and/or backside background layers 307 or 407, and/or the thickness of reflective coating 409 may be adjusted to ensure that further production of scratch-off products 300 or 400 meet the defined transmission optical density. In another embodiment, an additional lower background layer (not shown) and an additional lower opacity layer (not shown) may be added above lower opacity layer 303 or 403 to ensure that further production of scratch-off products 300 or 400 meet the defined transmission optical density. If secure substrate 300 or 400 meets or exceeds the defined transmission optical density at step 527, method step 529 is not performed and the method steps end at step 527. The order of operations 517, 519, 521, and 525 may vary depending on factors including the available equipment configuration and whether the reflective coating is applied.

Layers of coating or ink can be applied in the embodiments of FIGS. 1-5 using a variety of methods, including, for example, through the use of a metered size press, a roll coater, a blade coater, a slot-die coater, a curtain coater, a roll printer (e.g., gravure or flexography) or any other method known in the art. The secure substrate 101, 200, 300 or 400 can be produced in the form of sheets or in the form of a roll. The secure substrate can then be used to manufacture scratch-off products, eliminating the need to coat or print any additional lower security layers to protect against delamination, candling, fluorescence, diffusion, electrostatic charge, etc.

Other objects, advantages and embodiments of the various aspects of the present invention will be apparent to those who are skilled in the field of the invention and are within the scope of the description and the accompanying Figures. For example, but without limitation, structural or functional elements might be rearranged, or method steps reordered, consistent with the present invention. Similarly, principles according to the present invention could be applied to other examples, which, even if not specifically described here in detail, would nevertheless be within the scope of the present invention.

What is claimed is:

1. A method for manufacturing a secure Scratch-Off-Coating (SOC) protected document, wherein the document is composed of a separately manufactured secure substrate comprised of at least one lower opacity layer covering the entirety of the substrate that does not penetrate the substrate and at least one lower background layer applied on top of the lower opacity layer also covering the entirety of the substrate, a separate manufacturing process applies a printed indicia to the separately manufactured secure substrate with a series of secure SOC ink film layers also printed, the method comprising:

(a) printing at least one indicia on the secure substrate;

(b) printing at least a protect and release layer, an upper opacity layer, and an upper background layer, together comprising the secure SOC ink film layers, that are printed on top of the separately manufactured secure substrate and at least one indicia; and (c) measuring the transmission optical density of the composite separately manufactured secure substrate and secure SOC ink film layers to determine whether the measured transmission optical density meets or exceeds the defined minimum transmission optical density, such that the measured optical density is a function of both the separately manufactured secure substrate and the SOC ink film layers.

2. The method of claim 1 wherein the transmission optical density of the separately manufactured secure substrate is lessened by reducing the concentration of the colorant of the lower opacity layer which is offset by an increase in the optical density of the SOC ink film layers such that the defined minimum transmission optical density is maintained.

3. The method of claim 1 wherein the transmission optical density of the separately manufactured secure substrate is lessened by reducing the thickness of the lower opacity layer which is offset by an increase in the optical density of the SOC ink film layers such that the defined minimum transmission optical density is maintained.

4. The method of claim 1 wherein the transmission optical density of the SOC ink film layers are lessened by reducing the concentration of the colorant of at least one SOC ink film layer which is offset by an increase in the optical density of the separately manufactured secure substrate such that the defined minimum transmission optical density is maintained.

5. The method of claim 1 wherein the transmission optical density of the SOC ink film layers are lessened by reducing the concentration of the thickness of at least one SOC ink film layer which is offset by an increase in the optical density of the separately manufactured secure substrate such that the defined minimum transmission optical density is maintained.

6. The method of claim 1 wherein the defined minimum transmission optical density is 3.5.

7. The method of claim 1 where the at least one lower opacity layer and at least one lower background layer covering the entirety of the substrate are applied via curtain coaters.

8. The method of claim 1 where the at least one lower opacity layer and at least one lower background layer covering the entirety of the substrate are applied via blade coaters.

9. The method of claim 1 where the at least one lower opacity layer and at least one lower background layer covering the entirety of the substrate are applied via roll printer flexography.

10. The method of claim 1 where the at least one lower opacity layer and at least one lower background layer covering the entirety of the substrate are applied via roll printer gravure.

11. The method of claim 1 where at least one primer coating is applied to the at least one lower background layer.

* * * * *